United States Patent [19]

Binney

[11] 4,257,464

[45] Mar. 24, 1981

[54] PROTECTIVE GUN COVER

[76] Inventor: Robert L. Binney, 15 Knottingham Ct., Stockbridge, Ga. 30281

[21] Appl. No.: 59,675

[22] Filed: Jul. 23, 1979

[51] Int. Cl.[3] ..... F41C 27/00; B65D 81/26; B65D 85/00

[52] U.S. Cl. ..... 150/52 R; 206/207; 206/317; 224/911

[58] Field of Search ..... 206/317, 207, 205; 150/52 R; 224/911

[56] References Cited

U.S. PATENT DOCUMENTS

| | | | |
|---|---|---|---|
| 1,240,880 | 9/1917 | Rink | 206/207 |
| 2,524,931 | 10/1950 | Schoellkoff et al. | 150/52 R |
| 3,540,508 | 11/1970 | Couch | 150/52 R |

*Primary Examiner*—William T. Dixson, Jr.

*Attorney, Agent, or Firm*—Newton, Hopkins & Ormsby

[57] ABSTRACT

To protect the finish of hand guns, rifles and firearms from rust and corrosion, a fabric cover is provided having an interior pile facing which is treated with a petroleum distillate mixture having metal protecting qualities. The fabric cover is capable of breathing. The cover can be used as a lining for a gun storage case or holster.

3 Claims, 5 Drawing Figures

PROTECTIVE GUN COVER

BACKGROUND OF THE INVENTION

Various types of gun cases, covers and holsters are known in the prior art. Some broadly relevant examples of the patented prior art are contained in the following U.S. Pat. Nos. made of record herein under 37 C.F.R. 1.56:

202,733; 1,062,238;
787,852; 1,102,195;
894,569; 1,110,993.

The objective of the invention is to satisfy a need in the art which is not satisfied by any known device including those disclosed in the above-referenced patents. The need in question is the protection of the finishes of expensive hand guns and rifles from rust and other corrosion resulting in the pitting of finishes over long periods of time when the guns are in storage in gun cases and the like. Even though some gun cases have fabric linings mainly for the sake of appearance, the cases do not effectively exclude moisture and over a period of time rusting of the gun can occur, even in a closed case. Moisture condensation due to temperature changes can also occur in closed gun cases.

Leather holsters for hand guns retain tanning acids and chemicals used in the preparation of leather and these are highly caustic and can also damage the finish on the gun over a period of time. The blueing on the metal parts of a hand gun, particularly on the muzzle, can be worn away by repeated insertions and withdrawals of the gun from its holster.

The purpose of the invention is to deal effectively with all of these problems through the provision of a gun cover which may also serve as a holster or gun case lining. The cover or lining is formed of knitted or woven textile fabric, preferably an acrylic polyester fabric, having a pile facing on one surface thereof known in the art as a "tumbled" or "shearling" finish, sometimes called "fake fur" or "plush pile".

This pile facing is treated by spraying onto it a metal-protecting petroleum distillate mixture of two commerical types in a precise ration. In the finished gun cover, or case, or holster lining, the treated pile facing is in direct contact with the metal parts of the gun and keeps them lubricated and protected against rusting, corrosion and pitting. Insertion and removal of the gun repeatedly from the treated holster lining in accordance with the invention has a cleaning and polishing effect, preserving and improving the appearance of the finish. The cover or lining, unlike zippered plastic covers, has the ability to breathe and prevents moisture from condensing on the gun.

The product is very inexpensive, easy to manufacture and can be shaped to accommodate many different types of guns.

Other advantages of the invention and features will become apparent during the course of the following description.

DETAILED DESCRIPTION

Figure 1:
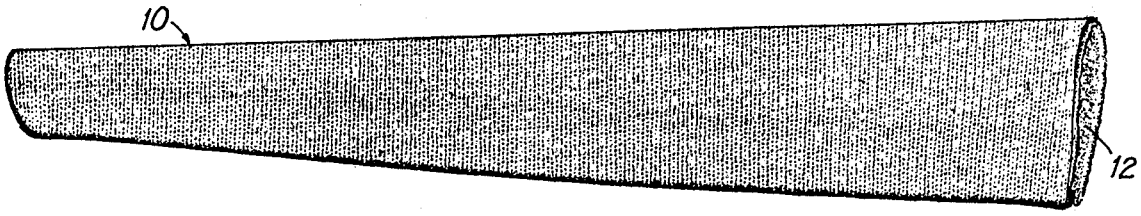
FIGS. 1 is a perspective view of a cover for rifles according to the invention.
Figure 2:
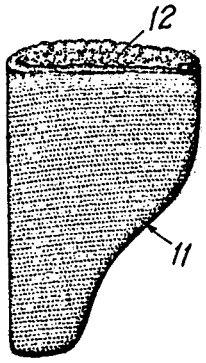
FIG. 2 is a perspective view of a hand gun cover.

Referring to the drawings in detail wherein like numerals designate like parts, the numeral 10, FIG. 1, designates a flexible free breathing textile pile fabric cover for a rifle or other long gun. In FIG. 2, the numeral 11 similarly designates a cover of the same material for hand guns. The covers may be constructed in various sizes and shapes to accept various types of guns.

Figure 4:
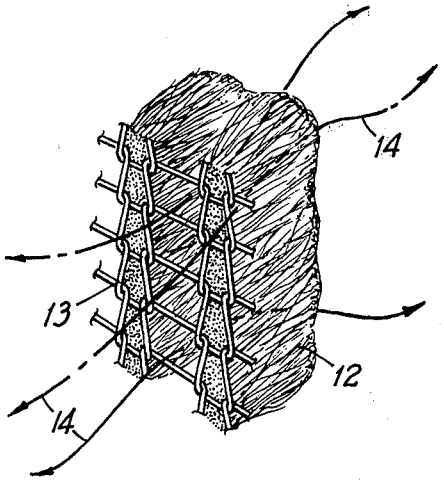
FIG. 4 is an enlarged fragmentary perspective view of pile fabric used in the making of the cover and showing its free breathing capability.

Preferably, the cover in either form is made from a knitted acrylic polyester fabric having a thick, soft and bulky pile surface 12 of the type known in the art as a "tumbled" or "shearling" finish, also sometimes called "fake fur" or "plush pile". The knitted fabric case for this pile is shown at 13 in FIG. 4. As indicated in that FIGURE by the directional arrows 14, the pile fabric from which the gun covers 10 and 11 are fabricated is free breathing and air can readily pass therethrough to eliminate or greatly lessen condensation of moisture on or around the enclosed gun.

In lieu of a flexible gun cover, such as shown in FIGS. 1 and 2, the invention may be embodied in a lining for a leather holster or for a rigid box-like gun case. In all instances, the thick slippery pile facing 12 is next to the gun in direct contact with its metal surfaces to protect the same against abrasive wear and to help in cleaning and polishing the finished surfaces of the gun, as where a hand gun is repeatedly inserted and withdrawn from its holster lined in accordance with the invention.

An important aspect of the invention resides in the treatment of the pile facing 12 by spraying it with a precise formulation of two petroleum distillates of a commerical type. One of the distillates is manufactured and sold in bulk form by WD-40 Company, 1061 Cudahy Place, San Diego, Calif. 92110 under the trademark TROUBLESHOOTER WD-40. This distillate product possesses lubricating, rust and corrosion resisting properties and condensation resistance. It also has metal cleaning properties. The other ingredient of the treatment material possessing similar properties is manufactured and sold by the Tri-Flon Company, 3180 Pullman St., Costa Mesa, Calif. 92626 under the trademark TRI-FLON. The treatment material, prior to spray application on the pile, is mixed in the ratio of 1 ounce of TRI-FLON lubrication to 4 ounces of TROUBLE-SHOOTER WD-40. Approximately one-fourth fluid ounce of this mixture is applied by spraying directly onto each square foot of the pile facing of the gun covering fabric. The spray treatment is long-lasting.

Figure 3:
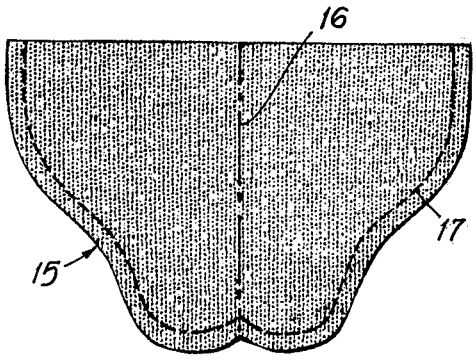
FIG. 3 is a plan view of a blank for making the hand gun cover.
Figure 5:
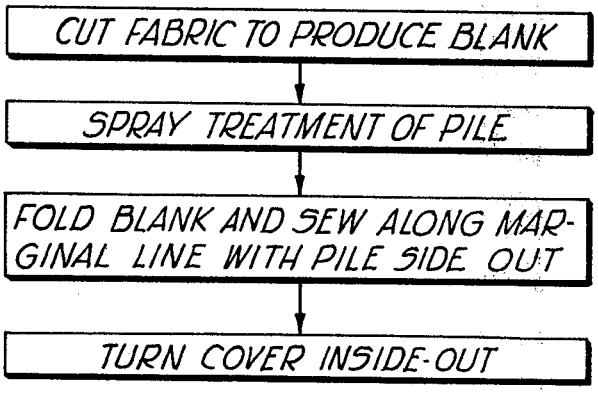
FIG. 5 is a flow chart of the manufacturing steps.

As depicted in FIGS. 3 and 5 of the drawing, the pile fabric is first cut marginally into a flat blank form 15 as a pattern for the particular gun cover, namely the hand gun cover 11 in the illustration of FIG. 3. Following this cutting, the spray treatment with the mixture of petroleum distillates takes place in the described manner, the spray being directed onto the pile facing 12. Next, the blank 15 is folded on a median line 16 with the pile facing 12 outermost and is stitched along a marginal line 17 to complete the gun cover. Finally, the sewn cover is turned inside-out, FIG. 2, so that the treated pile surface 12 is innermost.

The bulky nature of the pile covering has a cushioning effect which also protects the guns from scratches and dents.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A gun cover formed of a flexible free breathing textile fabric having an interior pile surface for contact with a gun placed in the cover, and the pile surface having applied thereto a lubricating rust and corrosion inhibiting material which is long lasting said free breathing fabric providing for the ready passage of air therethrough to lessen any condensation or moisture on or around an enclosed gun, said textile fabric being formed of acrylic polyester and said pile surface being a shearling pile surface, said lubricating material being applied to the pile surface in spray form and comprising a petroleum distillate composition that is applied to the pile surface approximately in the amount of ¼ fluid ounce per square foot of the pile surface, and said composition being a mixture of TRI-FLON and WD-40 in the approximate ratio of one ounce of TRI-FLON to four ounces of WD-40.

2. A gun cover as defined in claim 1, and said cover being shaped to receive a hand gun.

3. A gun cover as defined in claim 1, and said cover being shaped to receive a long gun.

* * * * *